US007510615B2

(12) United States Patent
Rode et al.

(10) Patent No.: US 7,510,615 B2
(45) Date of Patent: Mar. 31, 2009

(54) AGE-HARDENING COPPER ALLOY AS MATERIAL FOR PRODUCING CASTING MOLDS

(75) Inventors: Dirk Rode, Osnabrück (DE); Thomas Helmenkamp, Osnabrück (DE); Fred Riechert, Bramsche (DE)

(73) Assignee: KME Germany AG & Co. KG, Osnabruck (DE)

( * ) Notice: Subject to any disclaimer, the term of this patent is extended or adjusted under 35 U.S.C. 154(b) by 709 days.

(21) Appl. No.: 10/294,350

(22) Filed: Nov. 13, 2002

(65) Prior Publication Data

US 2003/0094220 A1 May 22, 2003

(30) Foreign Application Priority Data

Nov. 21, 2001 (DE) ..... 101 56 925

(51) Int. Cl.
*C22C 9/02* (2006.01)

(52) U.S. Cl. ..... 148/432; 148/433; 148/434; 148/435; 148/436

(58) Field of Classification Search ..... 148/432, 148/433, 434, 435, 436
See application file for complete search history.

(56) References Cited

U.S. PATENT DOCUMENTS 4,179,314 A * 12/1979 Wikle ..... 148/685
4,565,586 A * 1/1986 Church et al. ..... 148/685
4,657,601 A * 4/1987 Guha ..... 148/685
5,798,008 A * 8/1998 Nogami et al. ..... 148/682
6,083,328 A * 7/2000 Gravemann et al. ..... 148/432
6,228,242 B1 * 5/2001 Lavelaine et al. ..... 205/143

FOREIGN PATENT DOCUMENTS

EP 0 548 636 B1 6/1993
JP 04221030 * 8/1992
JP 04221031 * 11/1992

* cited by examiner

*Primary Examiner*—Sikyin Ip
(74) *Attorney, Agent, or Firm*—Kenyon & Kenyon LLP

(57) ABSTRACT

An age-hardening copper alloy made of—as expressed in each case in weight %—0.4% to a maximum of 2% cobalt which is partially replaceable by nickel, 0.1% through 0.5% beryllium, optionally 0.03% through 0.5% zirconium, 0.005% through 0.1% magnesium and possibly a maximum of 0.15% of at least one element from the group including niobium, manganese, tantalum, vanadium, titanium, chromium, cerium and hafnium. The remainder is copper inclusive of production-conditioned impurities and usual processing additives. This copper alloy is used as the material for producing casting molds, in particular for the sleeves of continuous casting rolls as components of a two-roll casting installation.

17 Claims, No Drawings

AGE-HARDENING COPPER ALLOY AS MATERIAL FOR PRODUCING CASTING MOLDS

BACKGROUND OF THE INVENTION

1. Field of the Invention

The invention relates to an age-hardening copper alloy as material for producing casting molds.

2. Description of Related Art

The worldwide aim, especially of the steel industry, to pour semifinished product as close to final dimensions as possible, in order to save hot and/or cold working steps, has led since about 1980 to a series of developments, such as single roll and two-roll continuous casting methods.

In these casting methods, very high surface temperatures appear at the water-cooled cylinders or rolls during casting of steel alloys, nickel, copper, as well as alloys that are only rolled with difficulty in the pouring range of the melt. In the case of close to final dimension casting of a steel alloy, the temperatures are about 350° C. to 450° C., the continuous casting and rolling sleeves being made of a CuCrZr material having an electrical conductivity of 48 $Sm/mm^2$ and a heat conductivity of about 320 W/mK. Materials based on CuCrZr were used up to now predominantly for continuous casting dies and casting wheels that were thermally highly stressed. In the case of these materials, the surface temperature drops cyclically to about 150° C. to 200° C., by the cooling of the casting rolls, with each revolution, shortly before the casting range. On the cooled rear side of the casting rolls, however, the temperature remains largely constant during the cycle, at about 30° C. to 40° C. The temperature gradient between the surface and the rear side in combination with the cyclical change in the surface temperature of the continuous casting rolls causes thermal stress in the surface region of the sleeve material.

According to investigations of the fatigue properties of the CuCrZr materials used up to now, at various temperatures, using an expansion amplitude of +/−0.3% and a frequency of 0.5 Hertz—these parameters approximately correspond to a rotational speed of the continuous casting rolls of 30 rpm—one may expect, for example, in the favorable case, a service life of 3000 cycles until cracks form, using a maximum surface temperature of 400° C., corresponding to a wall thickness of 25 mm above the water cooling. Therefore, the continuous casting rolls have to be reconditioned after as relatively early an operating time as about 100 minutes, for the purpose of removing surface cracks. In this context, the service life between reworking is, among other things, substantially dependent on the effectiveness of the lubrication/release agents at the casting surface, the constructive and process-conditioned cooling as well as the casting speed. For the purpose of exchanging the continuous casting rolls, the casting installation has to be stopped and the casting process has to be interrupted.

An additional disadvantage of the proven die material CuCrZr is its relatively low hardness of about 110 HBW to 130 HBW. However, in a single or two-roll continuous casting method it is not to be avoided that, even before the casting range, splashes appear on the roll surfaces. The solidified steel particles are then pressed into the relatively soft surfaces of the continuous casting rolls, whereby the surface quality of the cast strip of about 1.5 mm to 4 mm thickness are considerably impaired.

Compared to a CuCrZr alloy, the lower electrical conductivity of a known CuNiBe alloy, having an addition of up to 1% niobium, also leads to a higher surface temperature. Since the electrical conductivity behaves approximately proportionally to the heat conductivity, the surface temperature in the sleeve, of a continuous casting roll, made of the CuNiBe alloy as compared to a continuous casting roll having a sleeve made of CuCrZr, at a maximum temperature of 400° C. at the surface and 30° C. on the rear side will be increased to about 540° C.

Ternary CuNiBe and CuCoBe alloys do indeed basically demonstrate a Brinell hardness of more than 200 HBW, however the electrical conductivity of the standard semifinished products made of these materials, such as rod for manufacturing resistance welding electrodes or sheet or strip for manufacturing springs or leadframes, reach values of at most in the range of 26 $Sm/mm^2$ to about 32 $Sm/mm^2$. Under optimum conditions, with the use of these standard materials, a surface temperature of only about 585° C. could be reached at the sleeve of a continuous casting roll.

Even from the CuCoBeZr and CuNiBeZr alloys basically known from U.S. Pat. No. 4,179,314, no hints are seen that conductivity values of >38 $Sm/mm^2$ in conjunction with a minimum hardness of 200 HBW could be achieved.

Within the scope of EP 0 548 636 B1, the use of an age-hardening copper alloy is also related art, which has 1.0% to 2.6% nickel that may be fully or partially replaced by cobalt, 0.1% to 0.45% beryllium, optionally 0.05% to 0.25% zirconium and possibly up to a maximum of 0.15% of at least one of the group of elements including niobium, tantalum, vanadium, titanium, chromium, cerium and hafnium, the rest being copper inclusive of production contaminations and the usual processing additives, having a Brinell hardness of at least 200 HBW and an electrical conductivity greater than 38 $Sm/mm^2$ as the material for producing continuous casting rolls and wheels.

Alloys having these compositions, such as the alloys CuCo2Be0.5 or CuNi2Be0.5, have disadvantages in their hot forming capability, because of their relatively high alloying element content. However, high heat deformation strains are required to attain a fine grained product having a grain size <1.5 mm (as in ASTM E 112), starting from a coarse-grained cast structure having a grain size of several millimeters. In particular, for large format casting rolls, up to this point, sufficiently large continuous casting rolls have been producible only at very high expenditure; however, technical shaping devices are hardly available for realizing, at a justifiable cost, a sufficiently high hot kneading for recrystallization of the cast structure into a fine grain structure.

SUMMARY OF THE INVENTION

It is an object of the invention to create an age-hardening copper alloy as a material for producing casting molds which are robust even at high casting speeds in the presence of changing temperature stresses, and which have a high resistance to fatigue at the working temperature customary for a mold.

These and other objects of the invention are achieved by an age-hardening copper alloy made of, as expressed in each case as weight %, 0.4% through 2% cobalt, which is partially exchangeable for nickel, 0.1% through 0.5% beryllium, optionally 0.03% through 0.5% zirconium, 0.005% through 0.1% magnesium and possibly a maximum of 0.15% of at least one element of the group including niobium, manganese, tantalum, vanadium, titanium, chromium, cerium and hafnium, the remainder being copper inclusive of manufacturing conditioned impurities and usual processing additives, as the material for producing casting molds.

DETAILED DESCRIPTION OF THE INVENTION

By the use of a CuCoBeZr(Mg) alloy having a specifically graded low content of Co and Be, on the one hand, one may ensure a still sufficient age-hardening of the material for achieving high strength, hardness and conductivity. On the other hand, only low heat deformation strain is required for the complete recrystallization of the cast structure and the setting of a fine-grained structure having sufficient ductility.

Due to a material thus developed for a casting mold, it is possible to increase casting speed by more than double, compared to the usual casting speed. In addition, a clearly improved surface quality of the cast strip is achieved. Also, a considerably longer service life is ensured for the mold. By mold one should understand not only stationary molds such as plate molds or tubular molds but also running-along molds such as continuous casting rolls.

A further improvement in the sleeve's mechanical properties, particularly an increase in tensile strength, may be advantageously achieved if the copper alloy contains 0.03% to 0.35% zirconium, and 0.005% to 0.05% magnesium.

According to a further specific embodiment, the copper alloy contains a proportion <1.0% of cobalt, 0.15% to 0.3% of beryllium and 0.15% to 0.3% of zirconium.

It is also of advantage if the ratio of cobalt to beryllium in the copper alloy is between 2 and 15. Most preferably, this ratio of cobalt to beryllium is 2.2 to 5.

The copper alloy may contain, in addition to cobalt, up to 0.6% nickel.

Further improvements of the mechanical properties of a mold may be achieved if the copper alloy contains up to a maximum of 0.14% of at least one element of the group including niobium, manganese, tantalum, vanadium, titanium, chromium, cerium and hafnium.

The mold is advantageously produced by the following processing steps: casting, hot working, solution treatment at 850° C. to 980° C., cold working up to 30% as well as age-hardening at 400-550° C. within a time period of 2 to 32 hours, the mold having an average grain size of 1.5 mm as per ASTM E 112, a hardness of at least 170 HBW, and an electrical conductivity of at least 26 Sm/mm$^2$.

It is of particular advantage if the mold in the age-hardened state has an average grain size of 30 μm to 500 μm as per ASTM E 112, a hardness of at least 185 HBW, a conductivity between 30 and 36 Sm/mm$^2$, a 0.2% yield strength of at least 450 MPa and an elongation at break of at least 12%.

The copper alloy according to the invention is particularly suitable for producing the sleeves of the casting rolls of a two-roll casting installation, which, in the case of casting close to final dimension strips made of non-ferrous metals, particularly strips of aluminum or aluminum alloys, are submitted to varying temperature stresses at high roll pressures.

For this purpose, each sleeve may be provided with a coating that reduces the permeability to heat. Thereby the product quality of the cast strip made of non-ferrous metal, however, particularly of aluminum or an aluminum alloy, may be increased even more. Based on the operating condition of the sleeve, the coating, specifically made of a copper alloy, is made effective, especially in the case of an aluminum strip, due to the fact that, at the beginning of a casting or rolling process, an adhesion layer forms, from the acting together of copper and aluminum on the surface of the sleeve, from which, then, during the further course of the casting process, aluminum penetrates the copper surface and there forms a stable, resistive diffusion layer, whose thickness and properties are essentially determined by the casting speed and cooling conditions. That clearly improves the surface quality of the aluminum strip and consequently the product quality.

The present invention is explained in greater detail below with reference to several examples cited in the tables. In the light of seven alloys (alloys A to G) and three comparison alloys (H to J), it is shown how critical the composition is to achieving the combinations of properties aimed for.

All the alloys were smelted in a crucible furnace and cast into round billets of equal format. The composition of the individual layers is given below in Table 1. The addition of magnesium is made for the pre-deoxidization of the melt, and the addition of zirconium acts positively on the hot ductility.

TABLE 1

| Alloy | Co(%) | Ni(%) | Be(%) | Zr(%) | Mg(%) | Cu(%) |
|---|---|---|---|---|---|---|
| A | 0.68 | — | 0.20 | 0.20 | 0.03 | Rest |
| B | 1.0 | — | 0.22 | 0.22 | 0.03 | Rest |
| C | 1.4 | — | 0.20 | 0.18 | 0.02 | Rest |
| D | 0.65 | — | 0.29 | 0.21 | 0.04 | Rest |
| E | 1.0 | — | 0.31 | 0.24 | 0.01 | Rest |
| F | 1.4 | — | 0.28 | 0.19 | 0.03 | Rest |
| G | 1.0 | 0.1 | 0.22 | 0.16 | 0.03 | Rest |
| H | — | 1.7 | 0.27 | 0.16 | — | Rest |
| 1 | 2.1 | — | 0.55 | 0.24 | — | Rest |
| J | — | 1.4 | 0.54 | 0.20 | — | Rest |

The alloys were subsequently pressed into flat bars using a low pressing ratio (=cross section of the cast block/cross section of the pressed bar) of 5.6:1 on an extrusion press at 950° C. Thereafter, the alloys were submitted to an at least 30-minute solution treatment above 850° C., using a subsequent water quenching, and after that, were age-hardened for 2 to 32 hours at a temperature range between 400° C. and 550° C. The combinations of properties attained are shown in Table 2 below.

TABLE 2

| Alloy | Rm MPa | $Rp_{0.2}$ MPa | A % | HBW 2.5 187.5 | El. Cond. Sm/mm$^2$ | Grain Size mm |
|---|---|---|---|---|---|---|
| A | 694 | 492 | 21 | 207 | 36.8 | 0.09-0.25 |
| B | 675 | 486 | 18 | 207 | 32.8 | 0.09-0.18 |
| C | 651 | 495 | 18 | 211 | 30.0 | 0.045-0.13 |
| D | 707 | 501 | 19 | 207 | 31.4 | 0.09-0.25 |
| E | 735 | 505 | 19 | 229 | 33.6 | 0.045-0.18 |
| F | 735 | 520 | 19 | 224 | 32.3 | 0.09-0.25 |
| G | 696 | 513 | 18 | 213 | 33.5 | 0.065-0.18 |
| H | 688 | 556 | 10 | 202 | 41.0 | 2-3 |
| 1 | 784 | 541 | 11 | 229 | 30.3 | 1.5-3 |
| J | 645 | 510 | 4 | 198 | 30.9 | 4-6 |

Rm = tensile strength
$Rp_{0.2}$ = 0.2% yield strength
A = elongation at break
HBW = Brinell hardness As may be seen from the combinations of properties, the alloys according to the present invention, particularly for producing the sleeve of a mold, attain the aimed-for recrystallized fine grained structure while having an appropriately good elongation at break. In the case of comparison alloys H to J, there is a grain size of more than 1.5 mm, which reduces the ductility of the material.

An additional increase in strength may be attained by cold forming before the age-hardening. Table 3 below gives the property combinations of alloys A to J, which are achieved by solution treatment of the pressed material for at least 30 minutes above 850° C. and subsequent water quenching, 10% to 15% cold rolling (reduction in cross section) and then age-hardening from 2 to 32 hours at a temperature range between 400° C. and 550° C.

TABLE 3

| Alloy | Rm MPa | $Rp_{0.2}$ MPa | A % | HBW 2.5 187.5 | El. Cond. $Sm/mm^2$ | Grain Size mm |
|---|---|---|---|---|---|---|
| A | 688 | 532 | 20 | 211 | 36.7 | 0.13-0.25 |
| B | 679 | 534 | 18 | 207 | 34.6 | 0.045-0.18 |
| C | 741 | 600 | 17 | 227 | 34.4 | 0.065-0.18 |
| D | 690 | 537 | 21 | 207 | 32.6 | 0.065-0.25 |
| E | 735 | 576 | 19 | 230 | 34.7 | 0.045-0.18 |
| F | 741 | 600 | 17 | 227 | 34.4 | 0.13-0.25 |
| G | 695 | 591 | 15 | 224 | 33.0 | 0.18-0.35 |
| H | 751 | 689 | 9 | 202 | 40.9 | 2-4 |
| 1 | 836 | 712 | 10 | 229 | 31.0 | 2-3 |
| 1 | 726 | 651 | 6 | 198 | 31.5 | 3-6 |

Alloys A to G according to the present invention, in turn, demonstrate good elongations at break and a grain size less than 0.5 mm, while comparison alloys H to J have a coarse grain, having a grain size greater than 1.5 mm and lower values of elongation at break. Thus, these copper alloys have clear processing advantages during the production of sleeves, particularly for large continuous casting rolls of two-roll casting installations, whereby it is made possible to produce a fine grained end product having optimum basic properties for their field of application.

What is claimed is:

1. An age-hardening copper alloy for producing casting molds, comprising in weight %: 0.4% through 2% cobalt, which may be partially substituted by nickel, 0.1% through 0.5% beryllium, manganese up to 0.15%, at least one element selected from the group consisting of niobium, tantalum, and vanadium, and a remainder of copper, wherein the alloy in the age-hardened state has an average grain size of 90 μm to 1,500 μm as per ASTM E 122, and an electrical conductivity of between 30 and 36 $Sm/mm^2$.

2. The copper alloy according to claim 1, which includes 0.03% through 0.5% zirconium and 0.005% through 0.1% magnesium.

3. The copper alloy according to claim 2, which contains 0.03% to 0.35% zirconium and 0.005% to 0.05% magnesium.

4. The copper alloy according to claim 3, having a ratio of cobalt to beryllium of between 2 and 15.

5. The copper alloy according to claim 2, which contains less than 1.0% cobalt, 0.15% to 0.3% beryllium and 0.15% to 0.3% zirconium.

6. The copper alloy according to claim 5, having a ratio of cobalt to beryllium of between 2 and 15.

7. The copper alloy according to claim 2, having a ratio of cobalt to beryllium of between 2 and 15.

8. The copper alloy according to claim 7, having a ratio of cobalt to beryllium of between 2.2 and 5.

9. The copper alloy according to claim 2, further comprising up to 0.6% nickel in addition to cobalt.

10. The copper alloy according to claim 2, which contains a maximum of 0.15% of at least one element from the group including niobium, manganese, tantalum, vanadium, titanium, chromium, cerium and hafnium.

11. The copper alloy according to claim 1, having a ratio of cobalt to beryllium of between 2 and 15.

12. The copper alloy according to claim 11, having a ratio of cobalt to beryllium of between 2.2 and 5.

13. The copper alloy according to claim 11, which contains a maximum of 0.15% of at least one element from the group including niobium, manganese, tantalum, vanadium, titanium, chromium, cerium and hafnium.

14. The copper alloy according to claim 1, further comprising up to 0.6% nickel in addition to cobalt.

15. A casting mold produced from the copper alloy according to claim 1 by hot working, solution treatment at 850° C. to 980° C., cold working up to 30%, and age-hardening at 400° C. to 550° C. within a time period of 2 to 32 h.

16. The casting mold according to claim 15, which in the age-hardened state has an average grain size of 90 μm to 500 μm, as per ASTM E 112, a 0.2% yield strength of at least 450 MPa and an elongation at break of at least 12%.

17. A sleeve of a continuous casting roll of a two-roll casting installation which is submitted to a changing temperature stress under high roll pressures during close to final dimension casting of strips made of non-ferrous metals, made of the copper alloy according to claim 1.

* * * * *